US005345802A

United States Patent [19]

Caporusso et al.

[11] Patent Number: 5,345,802

[45] Date of Patent: Sep. 13, 1994

[54] SHAPED GROOVE COUNTERMATRIX FOR ROTARY GROOVE PULLEY MATRIX AND COUNTERMATRIX BENDING HEAD PIPE BENDING MACHINES

[76] Inventors: Alessandro Caporusso; Mario Caporusso, both of Via Pantanelle, 21, Piedimonte San Germano, Frosinone, Italy

[21] Appl. No.: 29,063

[22] Filed: Mar. 10, 1993

[51] Int. Cl.[5] ..... B21D 7/04

[52] U.S. Cl. ..... 72/154; 72/159; 72/41; 72/44

[58] Field of Search ..... 72/154, 159, 149, 43, 72/41, 44, 217, 369, 387, 388

[56] References Cited

U.S. PATENT DOCUMENTS

| | | | |
|---|---|---|---|
| 4,130,004 | 12/1978 | Eaton | 72/154 |
| 4,355,528 | 10/1982 | Rothenberger | 72/217 |
| 4,765,168 | 8/1988 | Stange et al. | 72/159 |
| 4,959,984 | 10/1990 | Trudell et al. | 72/43 |
| 5,127,248 | 7/1992 | Sanseau et al. | 72/149 |

FOREIGN PATENT DOCUMENTS

| | | | |
|---|---|---|---|
| 530611 | 8/1954 | Belgium . | |
| 1917926 | 10/1969 | Fed. Rep. of Germany . | |
| 1752210 | 5/1971 | Fed. Rep. of Germany . | |
| 2501545 | 9/1982 | France . | |
| 0792999 | 4/1958 | United Kingdom | 72/44 |

*Primary Examiner*—David Jones
*Attorney, Agent, or Firm*—Young & Thompson

[57] ABSTRACT

A shaped groove countermatrix for a rotary groove pulley matrix and a countermatrix head pipe bending machine has a semicircular cross-sectional tract and an end tract (2) tapered, both longitudinally and transversely, according to substantially elliptic profiles (20). The end tract (2) has its cross section substantially determined by the arcs (4, 4') of two ellipses (12) with their major axes (6, 6') parallel to and slightly offset with respect to a plane (8) of longitudinal symmetry of the groove (10). The tapering of the end tract (2) starts from a substantially parabolic profile (14) which has its axis on the plane (8) of longitudinal symmetry of the groove (10) and its vertex (16) at a short distance from the exit edge (18) of the groove (10). A well (22) allows for feeding a lubricating fluid onto the groove (10) which is in fluid communication therewith through a hole (24) via a wick (24'). A check valve (26) allows recharge of the well (22) with the lubricating fluid.

2 Claims, 1 Drawing Sheet

SHAPED GROOVE COUNTERMATRIX FOR ROTARY GROOVE PULLEY MATRIX AND COUNTERMATRIX BENDING HEAD PIPE BENDING MACHINES

BACKGROUND OF THE INVENTION

1. Field of the Invention

The present invention relates to a shaped groove countermatrix for a rotary groove pulley matrix and countermatrix bending head pipe bending machines.

2. Description of the Related Art

The operating principle of such machines is to stress a pipe to be bent to bending, thus arranging the latter between the grooves of the matrix and of the countermatrix and making the pulley matrix to rotate on its axis, which pulley matrix is assembled on a driving shaft and drags the pipe along a bending path by friction in its groove.

In order to reduce ovalization as much as possible and to avoid wrinkling and breaking of the pipe during the bending operation, countermatrices are used in the prior art and have grooves shaped according to suitable geometries, as is exemplified in Italian Patent Nos. 1.147.601 and 1.172.068, granted to the same Applicants for a U.S. Patent on the present invention.

Moreover, in most cases one proceeds to the lubrication of the contact between the pipe and the countermatrix, to avoid seizures during the bending operation. This lubrication must, for instance, be carried out necessarily for aluminum pipes and for pipes with a sheath in plastic. The lubricant is sprayed or applied with a brush.

The shaped groove of the prior art that better achieves its end has been suggested by the same applicants for a U.S. Patent on the present invention, and has a semicircular cross section except in an end tract, which is the exit in the sense of a feed of the pipe during the bending operation. Such an end tract is tapered both longitudinally and transversely towards the exit edge, starting from a semicircular cross section of the groove itself, and has its cross section made up of two ellipses with their major axes parallel to and slightly offset from the plane of longitudinal symmetry of the groove, which ellipses are equal to each other and inferiorly radiused by a tract which is elliptic too.

However, such a countermatrix has the problem that the pipes bent utilizing it show a visible circular tapering at the ends of the bending tracts.

As regards the lubrication of the preceding countermatrices to prepare them for the bending operation, such lubrication has the shortcoming of being difficult and time consuming.

SUMMARY OF THE INVENTION

The object of the present invention is to provide a shaped countermatrix that does not have the shortcoming of giving rise to a visible circular tapering in the bent pipe.

Another object of the present invention is to provide a countermatrix that does not have to be lubricated by an operator, but that is, on the contrary, self-lubricated.

Therefore, the present invention relates to a shaped groove for a groove pulley rotary bending head and countermatrix pipe bending machine, having an end tract in the sense of a feed of a pipe, which end tract is tapered both longitudinally and transversely, according to substantially elliptic profiles, with a cross section substantially determined by the arc, included between the edges of the preceding semicircular cross-sectional tract, of the curve made up of two ellipses with their major axes parallel to and slightly offset from the plane of longitudinal symmetry of the groove, which ellipses are equal to each other and radiused by tracts which are elliptic too, the tapering starting from the preceding semicircular cross-sectional tract according to a substantially parabolic profile, with its symmetry axis on the longitudinal symmetry plane of the groove, and its convexity turned towards the exit edge of the groove and arranged at a short distance from the same.

According to another aspect, the present invention relates to a shaped groove countermatrix for a groove pulley rotary bending head and countermatrix pipe bending machine, which comprises means for feeding lubricating fluid in fluid communication with the surface of the groove through a hole and wick means inserted in the latter.

The countermatrix of the present invention has the aesthetic advantage of extending, by virtue of its geometry, the collar tapering which was had in the prior art along a substantially parabolic profile outstretched into the bending tract of the pipe, thus rendering it substantially invisible at first sight.

Another advantage is relevant to the fact that, by virtue of its self-lubricated construction, the invention does not impose on the operator a lubricant application downtime.

BRIEF DESCRIPTION OF THE DRAWING

The present invention will be best understood on the basis of the following detailed disclosure of its preferred embodiment, given only as a matter of example and not as a matter of restriction, considered with reference to the annexed drawings, wherein.

DETAILED DESCRIPTION OF THE PREFERRED EMBODIMENT

Figure 1:
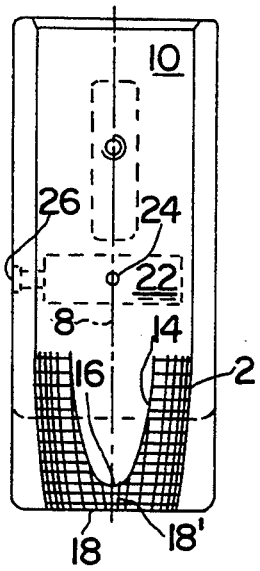
FIG. 1 is a top view of the countermatrix of the present invention.
Figure 2:
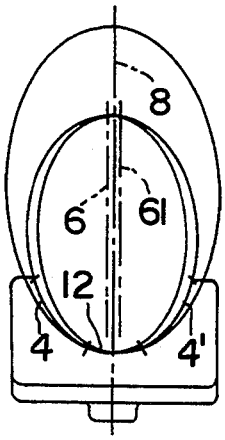
FIG. 2 is a view of a cross section thereof.
Figure 3:
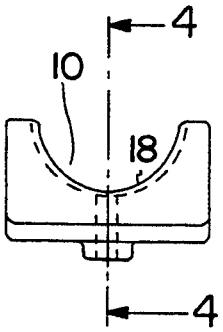
FIG. 3 is a front view.
Figure 4:
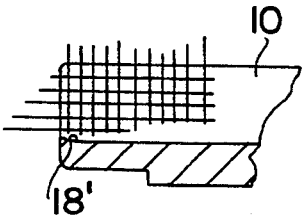
FIG. 4 is a section view according to line 4—4 in FIG. 3.
Figure 5:
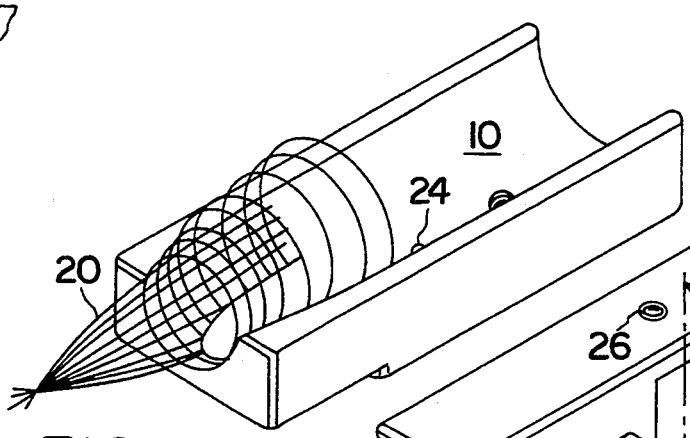
FIG. 5 is a front perspective view.

As can be observed in FIG. 1, the shaped groove countermatrix of the present invention has a semicircular section except in an end tract 2, shown by a network of lines. Such a tract, as can be observed from FIGS. 4 and 5, is tapered both in the transversal and in the longitudinal sense, according to substantially elliptic profiles. The cross section is constructed as is represented in FIG. 2. It is made up of two arcs 4, 4' of equal ellipses, with their major axes 6, 6' parallel to and slightly offset with respect to the plane of longitudinal symmetry 8 of a groove 10 shown in FIG. 1. The arcs 4, 4' of FIG. 2 are inferiorly radiused to each other by an arc of ellipse 12. The above-mentioned tapering starts not from a cross section of the groove 10, but from a parabolic profile 14 depicted in FIG. 1.

The portion of the groove 10 that actively works upon the pipe during the bending is only the end tract 2 with its novel geometry, which spreads the tapering on the pipe onto the parabolic profile 14, rendering the tapering substantially not visible at first sight. The parabolic profile 14 has its axis, i.e. line of axial symmetry, lying on the plane of longitudinal symmetry 8 of the groove 10, and pushes as far as its vertex 16 in the proximity of an exit edge 18 of the groove 10. It is worthy to be pointed out that a short tract 18' between the parabolic profile 14 and the exit edge 18 of the groove 10 has a rise which is visible in FIG. 4.

FIG. 5 shows elliptic profiles 20 according to which the end tract 2 of the groove 10 is tapered.

Figure 6:
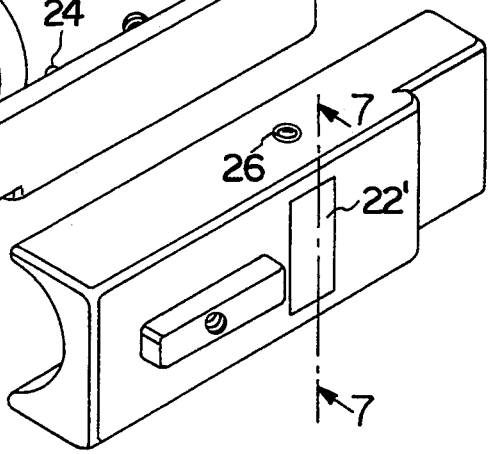
FIG. 6 is a rear perspective view.
Figure 7:
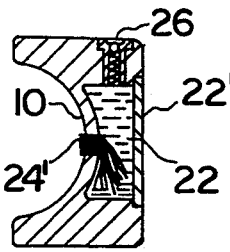
FIG. 7 is a section view according to line 7—7 in FIG. 6.

As represented in FIGS. 6 and 7, the countermatrix of the present invention has a well 22 for collecting the lubricating oil, closed by a plug 22', in fluid communication with the groove 10 through a hole 24 (see FIG. 5) through which the well 22 feeds an oil vein by means of a wick 24'. A spring loaded ball check valve 26 of a commercial type is provided to allow recharging of the well 22.

The present invention has been disclosed with reference to a preferred embodiment thereof, but it is to be understood that changes and/or additions can be made thereto, without so departing from the scope of protection defined by the appended claims.

For example, the lubricating vein feed could also come from a spigot arranged on the exterior of the countermatrix, instead of being directly incorporated therein.

We claim:

1. A shaped groove countermatrix for a rotary groove pulley matrix and a countermatrix head pipe bending machine, comprising:

a groove (10) having an exit edge (18), a semicircular cross-sectional tract with a curved surface, and an end tract (2) aligned in a direction of feed of a pipe to be bent in the groove (10) during a bending operation;

said end tract (2) being tapered, according to substantially elliptic profiles (20), both longitudinally and transversely with respect to the semicircular cross-sectional tract;

said end tract (2) further having its cross section substantially defined by arcs (4, 4') of two ellipses with major axes (6, 6') being parallel to and slightly offset with respect to the plane (8) of longitudinal symmetry of the groove (10); and said end tract (2) further being tapered starting from a substantially parabolic profile (14) having its line of axial symmetry lying in the plane (8) of longitudinal symmetry of the groove (10) and also having its vertex (16) spaced from the exit edge (18) of the groove (10).

2. The shaped groove countermatrix, according to claim 3, further comprising:

well means (22), located inside the countermatrix and spaced from the groove (10), for feeding a lubricating fluid onto the curved surface of the semicircular cross-sectional track of the groove (10);

plug means (22'), positioned at one end of the well means (22), for preventing loss of lubricating fluid from the well means (22);

hole means (24), formed between the well means (22) and the semicircular cross-sectional tract of the groove (10), for placing the well means (22) in fluid communication with the curved surface of the semicircular cross-sectional tract of the groove (10);

wick means (24'), arranged inside the hole means (24), for transferring the lubricating fluid from the well means (22) onto the curved surface of the semicircular cross-sectional tract of the groove (10); and check valve means (26), connected to the well means (22), for allowing the well means (22) to be recharged with the lubricating fluid.

* * * * *